US005113331A

United States Patent [19]

Nagengast

[11] Patent Number: 5,113,331

[45] Date of Patent: May 12, 1992

[54] VEHICLE HEADLAMP ASSEMBLY

[75] Inventor: William E. Nagengast, Anderson, Ind.

[73] Assignee: General Motors Corporation, Detroit, Mich.

[21] Appl. No.: 742,816

[22] Filed: Aug. 9, 1991

[51] Int. Cl.[5] ..... F21V 29/00

[52] U.S. Cl. ..... 362/267; 362/61

[58] Field of Search ..... 362/61, 267

[56] References Cited

U.S. PATENT DOCUMENTS 4,410,931 10/1983 DeGandia ..... 362/267

5,032,964 7/1991 Endo et al. ..... 362/61

*Primary Examiner*—Carroll B. Dority

*Attorney, Agent, or Firm*—Edward J. Biskup

[57] ABSTRACT

A vehicle headlamp having a reflector housing member closed by a lens member which is locked to the reflector housing member by concealed fastener means and serves to maintain the two members in a fixed relationship with each other during the curing of an adhesive location between the outer edges of the two members.

3 Claims, 3 Drawing Sheets

VEHICLE HEADLAMP ASSEMBLY

This invention concerns headlamps, in general, and more particularly relates to a vehicle headlamp in which the lens can be readily connected to the reflector housing by use of a separate fastener.

Certain current production headlamps having replaceable lamp bulbs, use four metal clips for securing the lens to the reflector housing so as to maintain the parts together while the adhesive located between the lens and the housing is being cured. One problem presented by the use of clips for interconnecting the lens to the reflector housing is that the clips, at times, are visible from the front of the vehicle and thereby presents an unattractive appearance from an esthetic standpoint to an observer.

Accordingly, the objects of the present invention are to provide a new and improved headlamp for a motor vehicle in which the lens is secured to the reflector housing by means of one or more metal clips none of which is visible from the front of the vehicle; to provide a new and improved headlamp for a motor vehicle that utilizes a clip type fastener means for locking the lens and the reflector housing together and wherein the lens and reflector housing are designed and configured so that the fastener means is not visible from the front of the headlamp; to provide a new and improved motor vehicle headlamp in which the lens and the reflector housing are held together by fastener means which are concealed by a peripheral part of the lens; and to provide a new and improved vehicle headlamp having a reflector housing member closed by a lens member which is secured to the reflector housing by concealed fastener means which serve to maintain the two members in a fixed relationship during the curing of an elastomeric adhesive provided between the two members.

The above and other objects are realized in accordance with the present invention by a vehicle headlamp having a reflector member provided with at least one concave parabolic reflecting surface and having a front open face surrounded by a connector portion around the entire margin of the open face of the reflector member. A lens member closes the open face of the reflector housing and has a connector portion formed thereon that is complementary and conforming to the connector portion of the reflector member so as to provide a mating joint for an elastomeric sealant. A tongue is integrally formed with the reflector housing member and projects rearwardly from the connector portion thereof. A flange is integrally formed with the projects rearwardly from the lens member beyond the connector portion of the reflector housing member and surrounds the entire periphery of the lens member so as to cause the flange to overlap a portion of the tongue. In addition, fastener means in the form of a metallic clip, is provided with one end of the clip being connected to an inner side of the flange on the lens member and the other end being connected to the tongue formed with the reflector housing member for locking the two members together so that the fastener means is not visible from the front of the headlamp.

A more complete understanding of the present invention can be obtained from the following detailed description when taken with the drawings in which.

Figure 1:
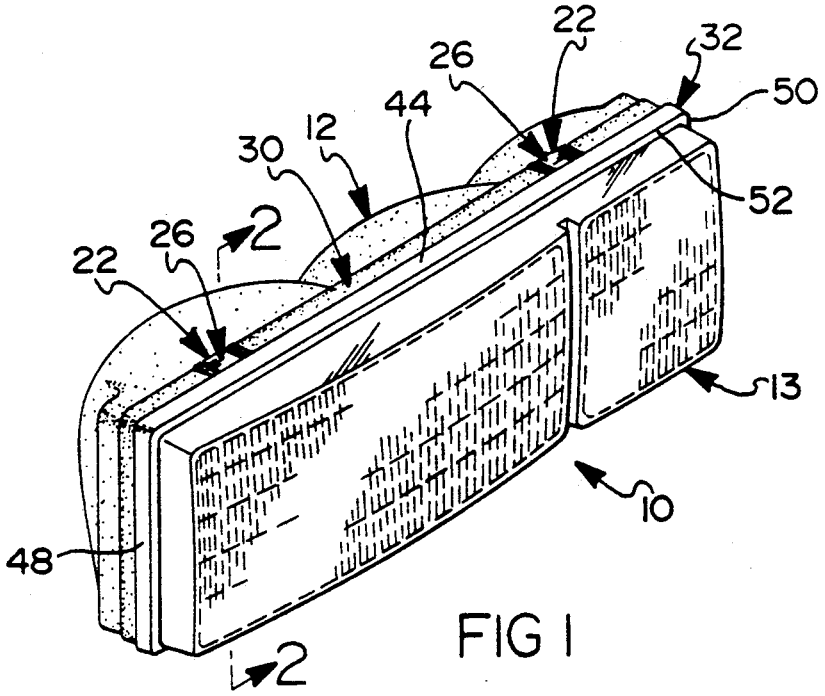
FIG. 1 is a perspective view of a headlamp assembly made in accordance with the present invention.
Figure 2:
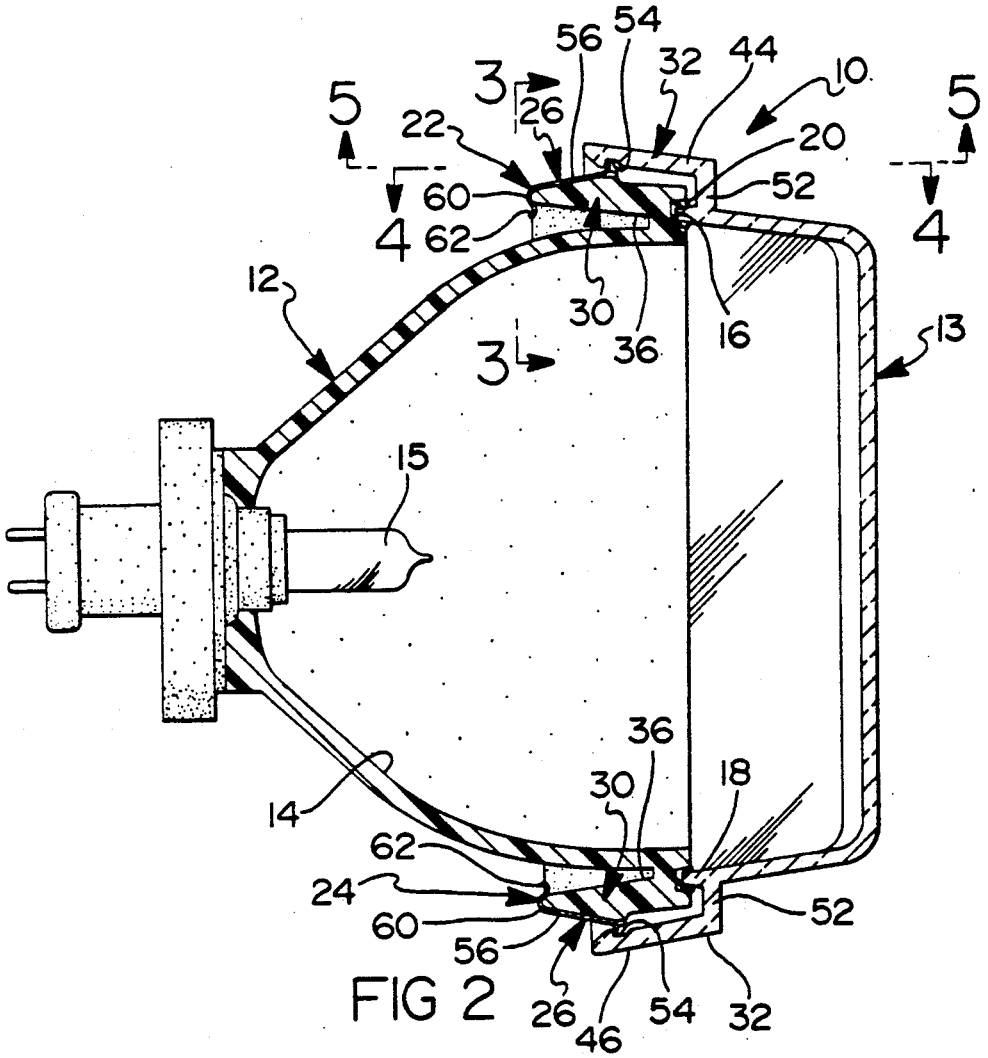
FIG. 2 is an enlarged sectional view taken on line 2—2 of FIG. 1 showing one of the four fastener means used for locking the lens member to the reflector housing member of the headlamp assembly.

Referring now to the drawings and more particularly FIGS. 1 and 2 thereof, a vehicle headlamp 10 is shown having a the usual reflector housing member 12 the open front face of which is closed by a lens member 13. Both the reflector housing member 12 and the lens member 13 are rectangular in configuration and preferably are made of a plastic material. The reflector housing member 12 is composed of multiple cavities each of which has an inner parabolic reflecting surface, such at indicated by reference numeral 14 in FIG. 2, for projecting a forwardly directed beam of light emanating at the filament of a replaceable light bulb 15. Thus, the cavities of the headlamp can provide a low beam, high beam and parking lamp illumination selected at the will of the driver.

Figure 6:
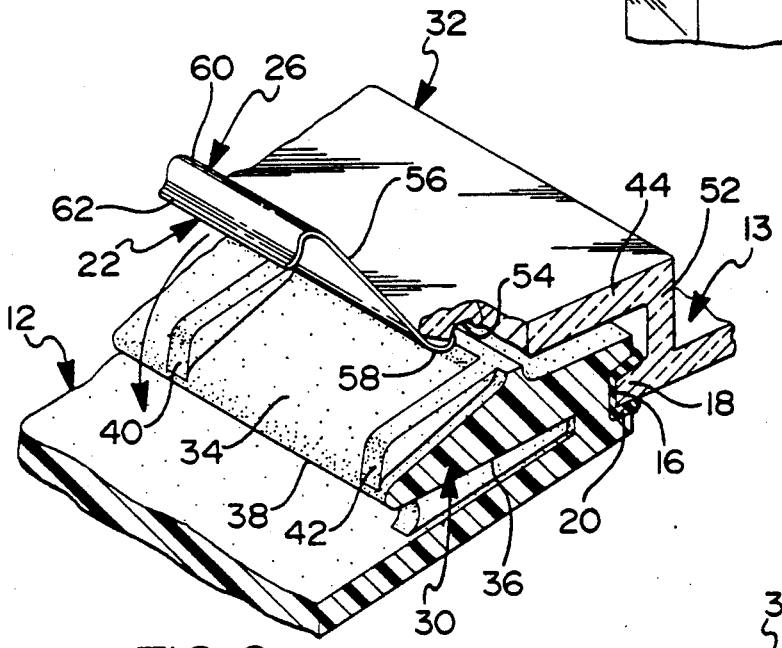
FIG. 6 is a perspective view of the fastener means showing the clip portion thereof being connected to the flange of the lens member.

As seen in FIGS. 2 and 6, suitable grooving or channeling 16 is provided around the entire margin of the open face of the reflector housing member 12 and complementary rib or ribbing 18 is provided around the entire inner part of the lens member 13. Both the grooving and ribbing 16 and 18, constitutes a connector portion provided on the lens member 13 and a connector portion provided on the reflector housing member 12. An adhesive and sealant 20 such as butyl is located in the channeling 16 of the reflector housing member 12 so when the aforementioned connector portions of the two members are joined together as seen in FIG. 2, the cavities of the reflector housing member 12 are sealed to prevent the ingress of foreign material into the body of the headlamp 10.

In this regard, it will be noted that in order to maintain the connector portions of the lens member 13 and the reflector housing member 12 in proper relative positions during the curing of the adhesive 20, four fastener means are provided along the periphery of the headlamp 10 for locking the lens member 13 to the reflector housing member 12. As seen in FIGS. 1 and 2, two of the fastener means (each indicated by reference numeral 22) are provided along the upper horizontal section of the reflector housing member 12 and two fastener means 24 are provided along the lower horizontal section of the member 12 in vertical alignment with the fastener means 22. All of the fastener means 22 and 24 is identical and, as seen in FIG. 2, each fastener means 22 and 24 includes a metallic clip 26 which cooperates with a tongue portion 30 formed with the reflector housing member 12 and a flange portion 32 formed with the lens member 13 for locking the two members together in a manner so that the clip 26 is concealed by the flange portion 32 and is not visible to an observer from the front of the headlamp 10.

Figure 3:
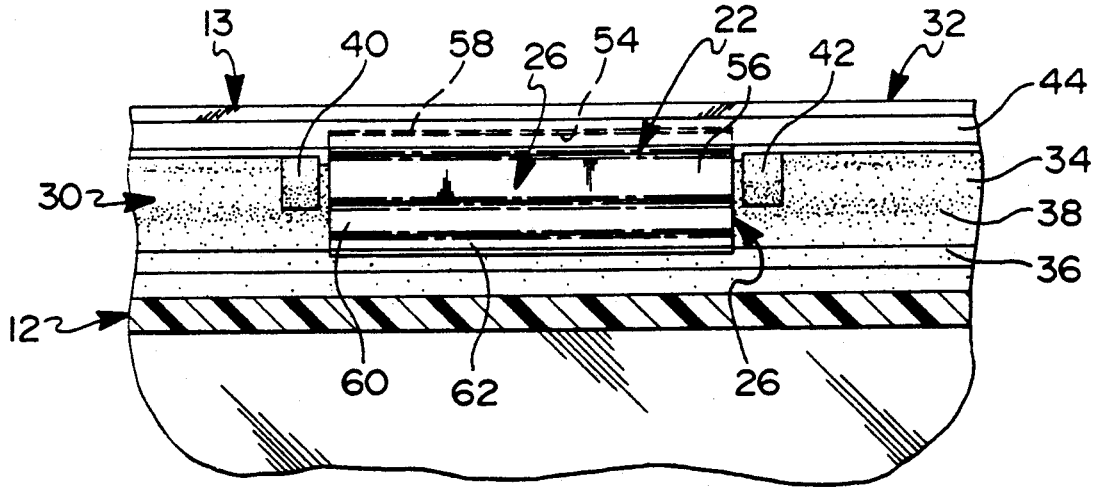
FIG. 3 is an enlarged view taken on line 3—3 of FIG. 2 showing the fastener means from the rear of the headlamp.
Figure 4:
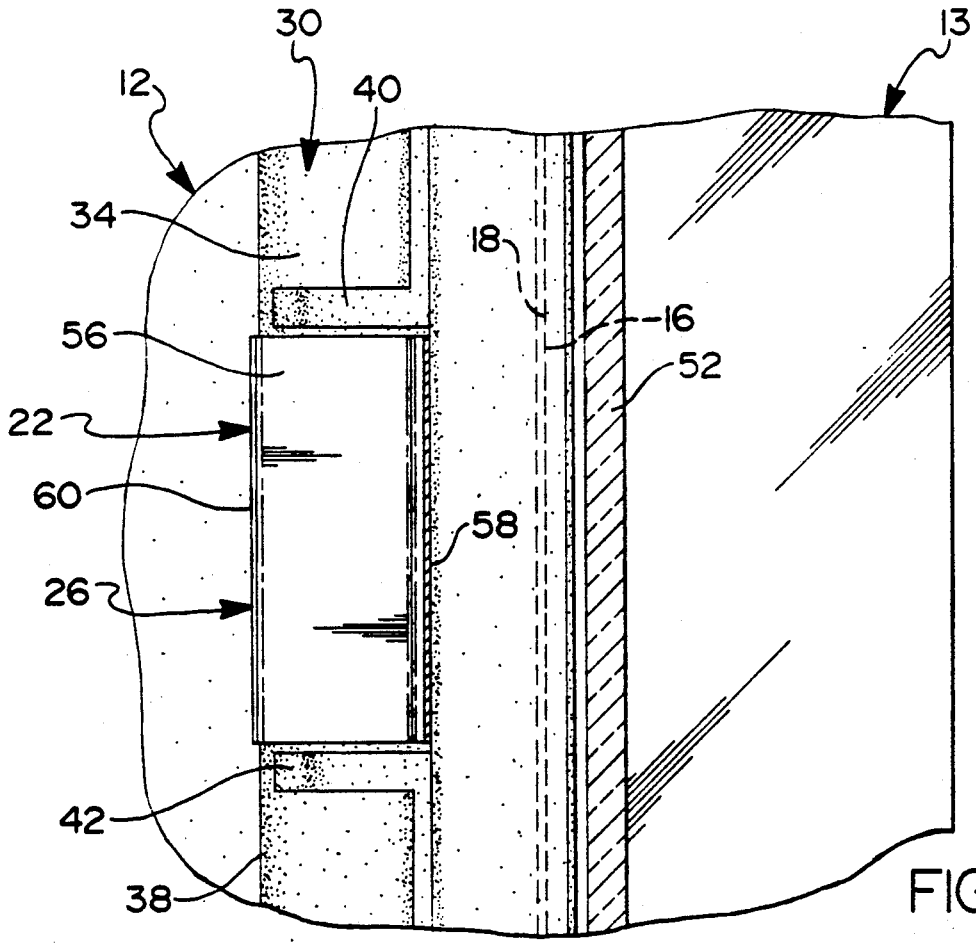
FIG. 4 is a an enlarged sectional view taken on line 4—4 of FIG. 2 showing the clip portion of the fastener means when viewed from above the headlamp.

More specifically, the tongue portion 30 is integrally formed with the reflector housing member 12 and projects rearwardly from the connector portion thereof. The tongue portion 30 takes the form of a tapered member defined by an upper planar surface 34 and a lower planar surface 36 which terminate in a rounded or curved support surface 38. As best seen in FIGS. 3, 4 and 6, a pair of identical and laterally spaced and parallel guide walls 40 and 42 extend vertically outwardly from the upper surface 34 of the tongue portion 30 and serve a purpose which will be explained hereinafter. In the preferred form, the tongue portion 30 surrounds the entire open face of the reflector housing member 12 so that the guide walls 40 and 42 of adjacent fastener means 22 and 24 are interconnected by similar configured rearwardly projecting tapered members of uniform cross section as seen in FIG. 1.

Figure 5:
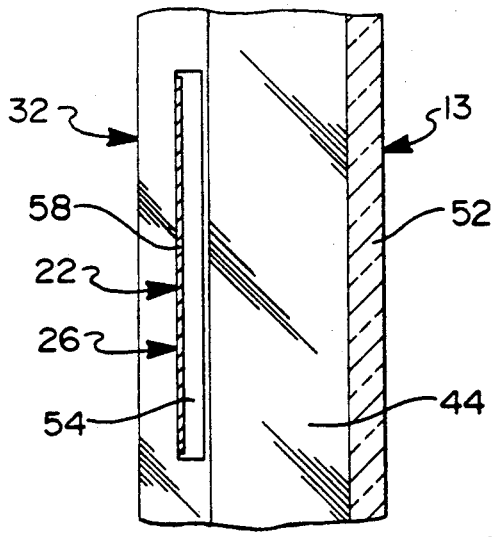
FIG. 5 is an enlarged sectional view taken on line 5—5 of FIG. 2 showing the detailed construction of the inner surface of the flange formed with the lens member.
Figure 7:
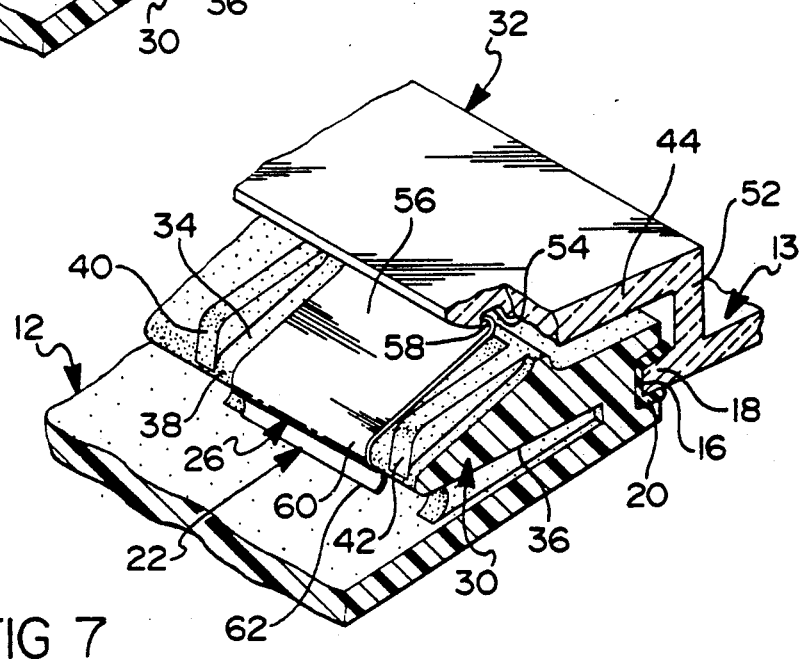
FIG. 7 is a view similar to that seen in FIG. 6 with the clip portion of the fastener means in the installed position for locking the lens member to the reflector housing member.

The flange portion 32 is integrally formed with and projects rearwardly from the lens member 13. As seen in FIGS. 1 and 2, the flange portion 32 includes a pair of horizontal sections 44 and 46 that extend the full horizontal length of the lens member 13 one being located at the upper end of the lens member 13 and the other at the lower end of the lens member 13. The horizontal sections 44 and 46 are interconnected by a pair of vertical sections 48 and 50 along the sides of the lens member 13. The horizontal sections 44 and 46 and the vertical sections 48 and 50 of the flange portion 32 are integrally connected to the lens member 13 by a radially outwardly extending and continuous wall 52 located forwardly of the rib or ribbing which constitutes the connector portion of the lens member. The horizontal and vertical sections 44–50 of the flange portion 32 are of uniform cross section and, as seen in FIG. 2, the flange portion 32 overlaps a part of the tongue portion 30. Also, as seen in FIGS. 5–7 above and between each pair of the guide walls 40 and 42, an elongated slot 54 is located in the inner surface of the flange portion 32.

The clip 26 is made of a metallic material and serves as a spring clip that has a generally "S" configuration in cross section. More specifically, the clip 26 includes a generally planar body portion 56 one end of which terminates with curved insert member 58. The other end of the body portion 56 also terminates with a curved member 60 which is curved in a direction opposite to that of the insert member. In addition, the curved member 60 has an extension 62 integrally formed therewith which can serve as a gripping means or handle as will be described herein below.

Thus, it should be apparent from the above description that during the assembly of the lens member 13 to the reflector housing member 12, adhesive will initially be provided in the form of a continuous bead in the channeling 16 or connector portion the reflector housing member 12. Afterwards, the horizontal and vertical sections the ribbing 18 or of connector portion of the lens member 13 will be aligned with the corresponding horizontal and vertical sections of the connector portion of the reflector housing member 12. The lens member 13 will then be moved towards the open face of reflector housing member 12 causing the vertical and horizontal ribs 18 of the lens member 13 to enter the corresponding vertical and horizontal channels 16 of the reflector housing member 12. This will then result in the automatic positioning of the flange portion 32 and the slot 54 relative to the guide walls 40 and 42 on tongue portion 30 as seen in FIGS. 2, 6, and 7. Afterwards, the insert member 58 of the clip 26 of each fastener menas is placed between the guide walls 40 and 42 and inserted into the slot 54 formed in the flange portion 32 and the handle 62 of the clip 26 is manually and forcibly pushed in the direction of the arrow as seen in FIG. 6 until the curved end 60 clamps onto and fully contacts the curved support surface 38 of the tongue portion 30 as seen in FIGS. 2 and 7. As a result, the lens member 13 is locked to the reflector housing member 12 so as to allow the adhesive located between the reflector housing member 12 and the lens member 13 to cure. An added feature of the invention is that the flange portion 32 serves to conceal the clip 26 so that it is not visible to an observer from the front of the headlamp. This makes for a more attractive appearing headlamp to the observer in that the entire periphery presents an uninterrupted smooth surface without any visible fastener means.

Various modifications and changes can be made in the above-described headlamp fastener means arrangements without departing from the spirit of the invention. Such changes and modifications are contemplated by the inventors and they do not wish to be limited except by the scope of the appended claims.

The embodiments of the invention in which an exclusive property or privilege is claimed are defined as follows:

1. A vehicle headlamp comprising a reflector housing member provided with at least one concave parabolic reflecting surface and having a front open face surrounded by a connector portion around the entire margin of the open face of the reflector housing member, a lens member closing the open face of the reflector housing member and having a connector portion complementary and conforming to the connector portion of the reflector housing member, an elastomeric adhesive located between said connector portions of the reflector housing member and the lens member, a tongue integrally formed with the reflector housing member and projecting rearwardly from the connector portion thereof, a flange integrally formed with and projecting rearwardly from the lens member beyond the connector portion of the reflector housing member and surrounding the entire periphery of the lens member so as to cause the flange to overlap a portion of the tongue, and a clip having one end connected to the inner surface of the flange and the other end connected to the tongue for locking the members together so that the fastener means is not visible from the front of the headlamp.

2. A vehicle headlamp comprising a reflector housing member provided with at least one concave parabolic reflecting surface and having a front open face surrounded by a connector portion around the entire margin of the open face of the reflector housing member, a lens member closing the open face of the reflector housing member and having a connector portion complementary and conforming to the connector portion of the reflector housing member, an elastomeric adhesive located between said connector portions of the reflector housing member and the lens member, a tongue terminating with a support surface and integrally formed with the reflector housing member and projecting rearwardly from the connector portion thereof, a flange integrally formed with and projecting rearwardly from the lens member beyond the connector portion of the reflector housing member and surrounding the entire periphery of the lens member so as to cause the flange to overlap a portion of the tongue, and a clip having one end located in a slot formed in the inner surface of the flange and the other end clamped to the support surface of the tongue for locking the members together so that the fastener means is not visible from the front of the headlamp.

3. A vehicle headlamp comprising a reflector housing member provided with at least one concave parabolic reflecting surface and having a front open face surrounded by a connector portion around the entire margin of the open face of the reflector housing member, a lens member closing the open face of the reflector housing member and having a connector portion complementary and conforming to the connector portion of the reflector housing member, an elastomeric adhesive located between said connector portions of the reflector housing member and the lens member, a tapered tongue terminating with a curved support surface and integrally formed with the reflector housing member and projecting rearwardly from the connector portion thereof, a flange located radially outwardly from the connector portion of the lens member and integrally formed with and projecting rearwardly from the lens member beyond the connector portion of the reflector housing member and surrounding the entire periphery of the lens member so as to cause the flange to overlap a portion of the tongue, and an S-shaped clip having one end located in a slot formed in the inner surface of the flange and the other end to the tongue for locking the members together so that the fastener means is not visible from the front of the headlamp.

* * * * *